United States Patent [19]

Herzog et al.

[11] Patent Number: 4,762,436

[45] Date of Patent: Aug. 9, 1988

[54] BIO-MECHANICAL NEURO-SENSORY KEYBOARD STRUCTURE AND OPERATING METHODS

[76] Inventors: Barbara D. Herzog; Stuart Herzog, both of 1433 E. Broadway, Tucson, Ariz. 85719

[21] Appl. No.: 886,635

[22] Filed: Jul. 16, 1986

Related U.S. Application Data

[63] Continuation-in-part of Ser. No. 681,895, Dec. 14, 1984, abandoned.

[51] Int. Cl.[4] ..... B41J 5/12

[52] U.S. Cl. ..... 400/491.3

[58] Field of Search ..... 400/490, 491.3, 472, 400/483; D18/6, 7

[56] References Cited

U.S. PATENT DOCUMENTS

| | | | |
|---|---|---|---|
| 726,107 | 4/1903 | Stanton | 400/491.3 X |
| 1,148,721 | 8/1915 | Scott | 400/490 |
| 1,718,694 | 6/1929 | Kurowski | 400/483 |
| 1,823,130 | 11/1928 | Smith | 400/483 |
| 2,350,059 | 4/1942 | Messchaert | 400/494 X |
| 2,628,030 | 2/1953 | Taylor | D18/6 X |
| 2,892,266 | 6/1959 | Tomkins | D18/7 X |
| 3,396,827 | 9/1962 | Harwell | 400/491.3 |
| 3,848,723 | 11/1974 | Hogue | 400/490 |
| 4,180,336 | 12/1979 | Lonsdale | 400/491.3 X |
| 4,565,460 | 1/1986 | Kline | 400/491.3 X |

FOREIGN PATENT DOCUMENTS

| | | |
|---|---|---|
| 847289 | 8/1952 | Fed. Rep. of Germany . |
| 57-87383 | 11/1980 | Japan . |

*Primary Examiner*—Edgar S. Burr
*Assistant Examiner*—Moshe I. Cohen

[57] ABSTRACT

The keys operated by the Middle Fingers in the Second Nearest Row and the Fourth Nearest Row of the Alpha-Numeric Core, i.e. QWERTY D K 3 and 8, and the center key on the Number Pad are provided with hand positioning structures.

Hand positioning with the Middle Fingers is based on the anatomical structure and bio-mechanical functioning of the arms, wrists, hands and fingers, and the hand positioning structures function by the neuro-sensory process of 2-point discrimination.

With minimal practice, use of the hand positioning structures quickly functions at a subconscious reflex level.

The hand positioning structures enable the operator to maintain visual focus and concentration on the text or display screen, and thereby eliminates unnecessary eye movement and text-reading errors due to eye movement.

The structures and methods enable eliminating Home Row, and thereby eliminates awkward movements and contortions and eliminates the errors resulting from awkward movements and contortions.

The structures and methods enable doing numbers with the hands positioned on the Number Row, rather than from Home Row, which also eliminates awkward movements and contortions, and improves speed, accuracy and efficiency in doing numbers.

The hand positioning structures provide bio-mechanical balance and symmetry for the fingers and hands; improves keyboard operation by increasing operating speed, accuracy, efficiency, mobility, flexibility, fluidity of movement, and productivity; reduces operator mental, emotional, visual, and neuro-muscular stress and fatigue; and facilitates learning how to operate a keyboard. The cost of the structure is nominal; no employee retraining expense is required.

17 Claims, 1 Drawing Sheet

BIO-MECHANICAL NEURO-SENSORY KEYBOARD STRUCTURE AND OPERATING METHODS

This is a continuation-in-part of application Ser. No. 06/681,895 filed Dec. 14, 1984 now abandoned.

BACKGROUND OF THE INVENTION

This invention relates to keyboards for computers, including terminals and input devices, word processing equipment, typewriters and similar equipment, and simulators of such equipment, and methods of operating these keyboards, and to teaching and learning how to operate these keyboards.

The keyboards currently in use for computers, word processors, typewriters and similar equipment have a standard Alpha-Numeric Core of forty keys in four transverse rows of ten keys each. There are three rows of Alphabet and punctuation keys with one row of Number keys above the Alphabet keys. Additional keys for symbols, functions and controls surround this Alpha-Numeric Core in less standardized arrangements. The number of additional keys surrounding the Alpha-Numeric Core has increased substantially with the development of electronic keyboards. The additional keys are frequently in groups such as the function, cursor movement, and editing groups and the number pad.

Fast, accurate operation of the Alpha-Numeric Core requires that the hands be accurately placed on the Core and that the operator keep the eyes and concentration focused on the text or display screen.

Existing keyboard structure does not facilitate accurate hand placement on the Alpha-Numeric Core; it actually causes hand misplacement. The results of hand misplacement include input errors, inefficiency and loss of effective operating time. Existing keyboard structure does not facilitate keeping the eyes on the text or screen; it actually causes the eyes to move away from the text to look at the keyboard. The results of this eye movement include text reading errors and eye fatigue.

Existing keyboard structure and the existing methods of operating the keyboard do not facilitate teaching or learning how to operate the keyboard; they actually cause substantial learning problems. The results of these problems include prolonged learning time, confusion, discouragement and increased cost.

In the Alpha-Numeric Core with the letters in the Standard or QWERTY arrangement, the sequence of letters and numbers in the rows is:

Fourth Nearest Row: 1 2 3 4 5 6 7 8 9 and 0
Third Nearest Row: Q W E R T Y U I O and P
Second Nearest Row: A S D F G H J K L and ;
Nearest Row: Z X C V B N M , . and ?

For two handed touch typing, the Alpha-Numeric Core is divided into a left-hand sector and a right-hand sector. In the traditional method of operating the keyboard known as the "Home Row" method, the eight fingers are placed on A S D F and J K L ; in the Second Nearest Row, which keys are commonly known as "Home Row." In that method, each of the eight fingers is assigned specific keys to operate as follows:

| Left Hand Fingers | | | | | Right Hand Fingers | | | |
|---|---|---|---|---|---|---|---|---|
| Little | Third | Middle | Index | | Index | Middle | Third | Little |
| 1 | 2 | 3 | 4 | 5 | 6 7 | 8 | 9 | 0 |

-continued

| Left Hand Fingers | | | | | Right Hand Fingers | | | |
|---|---|---|---|---|---|---|---|---|
| Little | Third | Middle | Index | | Index | Middle | Third | Little |
| Q | W | E | R | T | Y U | I | O | P |
| A | S | D | F | G | H J | K | L | ; |
| Z | X | C | V | B | N M | , | . | ? |

To operate a key other than a Home Row key, the operating finger is moved from its Home Row key to the key to be operated and back to its Home Row key, and the other fingers are kept on or over their Home Row keys. The use of Home Row results in unnecessary movements, unbalanced and awkward movements and contortions, impairs finger mobility, and causes learning problems. Doing numbers from Home Row requires long awkward unbalanced stretches, is slow, and inaccurate.

The consequences of lateral finger misplacement are substantial. Misplacing the fingers of the Right Hand one key to the left, ie. on H J K L instead of J K L ; causes every finger of the Right Hand to strike the wrong key in every row. Such a misplacement of the fingers on either hand causes errors, loss of productivity, loss of confidence, confusion, stress and frustration, discouragement and impairs learning.

Heretofore, tactile devices have been provided for keyboards such as in U.S. Pat. Nos. 2,350,059, to Meschaert, 3,848,723 to Hogue, and 4,180,336 to Lonsdale. The tactile devices in prior art do not work effectively because they are incompatible with the anatomical structure and bio-mechanical functioning of the fingers and hands, and with the neuro-sensory functioning in the fingertips, and other related bio-mechanical human factors. Among the major problems in the prior art are: they are not structured to provide 2-point discrimination or stereognosis; they do not provide central positioning of the hands and they are bio-mechanically eccentric; and they perpetuate the biomechanical problems of Home Row. The prior art prevents within hand-balance, increases the potential for error, decreases speed, and increases muscular stress. The devices have proved ineffective and at the present time Alpha-Numeric keyboards are still appearing without hand positioning devices or with devices that do not work effectively.

The advent of electronic keyboards and keycap molding processes have changed the topography and size of keyboards. Electronic keyboards have increased speed capability but have not provided the operator with bio-mechanical structures to facilitate increased operator speed.

Accomplishing higher rates of keyboarding speed at all levels of skill requires keyboard improvements that facilitate fast, accurate hand positioning and maintaining hand position without mechanically or otherwise interfering with the fluidity of finger movement, and that actually facilitate fluidity of finger movement.

Therefore, a need exists for a new and improved keyboard structure and method of operating the keyboard.

BRIEF SUMMARY OF THE INVENTION AND ITS OBJECTS

In this invention, the Third and Eighth keys in the Second Nearest Row and the Fourth Nearest Row of the Alpha-Numeric Core of the keyboard, which keys are operated by the Middle Finger of each hand, have hand positioning structures on the perimeter of the finger-strike surfaces of these keys. The hand positioning structures function with neuro-sensory two-point discrimination and stereognosis by the fingertips of the Middle Fingers; are easily sensed with light fingertip touch by the fingertips of the Middle Fingers; and provide the means by which the operator accurately positions and maintains the positions of the Middle Fingers on the Third and Eighth keys and accurately positions the hands on the keyboard without looking at the keyboard.

The invention also provides new methods of operating the Alpha-Numeric Core without placing the eight fingers on or over the eight Home Row keys, and of operating the Fourth Nearest Row by direct placement of the hands on the Number Row rather than from Home Row.

The center key in the Number Pad/Cursor Control Group, which is also operated by the Middle Finger, also has the hand positioning structure for the same purposes.

The objects of this invention are to:

improve keyboard operation by increasing operating speed, accuracy, efficiency, mobility, flexibility, fluidity of movement, and productivity;

provide bio-mechanical balance and symmetry for the fingers and hands;

eliminate errors due to misplacement and loss of placement and provide positional security;

enable the operator to maintain visual focus and concentration on the text or display screen, and thereby eliminate unnecessary eye movement and test-reading errors due to eye movement;

enable eliminating Home Row, and thereby eliminate awkward movements and contortions and eliminate the errors resulting from awkward movements and contortions;

enable doing numbers with the hands positioned on the Number Row, rather than from Home Row, which eliminates awkward movements and contortions, and improves speed, accuracy and efficiency in doing numbers;

reduce operator mental, emotional, visual, and neuromuscular stress and fatigue;

facilitate learning how to operate a keyboard; and accomplish these objects at nominal cost without requiring employee retraining expense.

DETAILED DESCRIPTION OF PREFERRED EMBODIMENT

In the following description, the term "keyboard" includes but is not limited to keyboards for computer terminals and input devices, word processing equipment, typewriters and similar equipment, and also to simulators of such operating equipment.

The invention will be described and illustrated by reference to the Alpha-Numeric Core for such a keyboard, with the letters arranged in the Standard or QWERTY sequence. The invention can similarly be applied to any keyboard and to any other arrangement or combination of letters, numbers or characters, and to keyboards used on other equipment.

Figure 1:
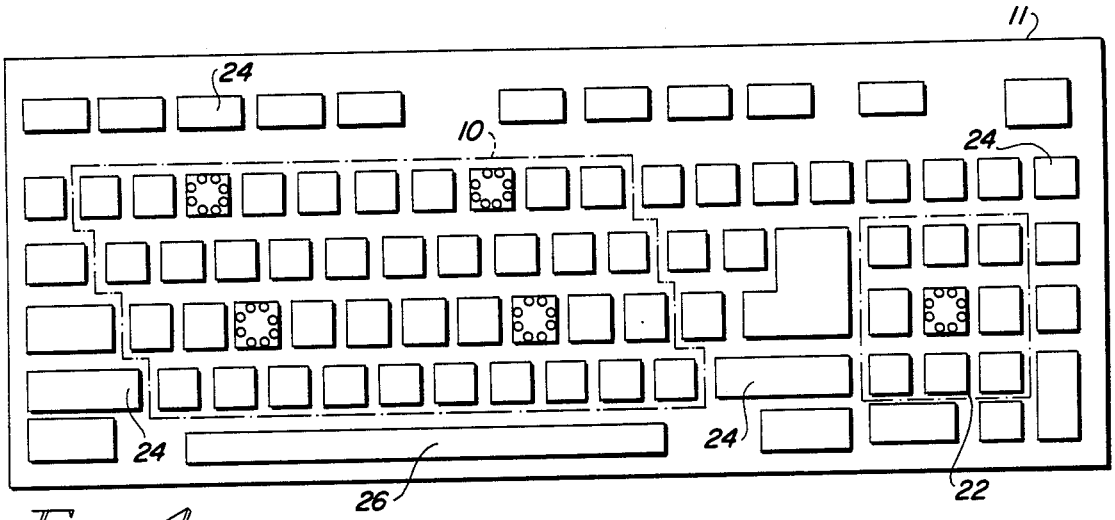
FIG. 1 is a plan view of a computer keyboard having an Alpha-Numeric Core, Number Pad/Cursor Control Group, and other character, control and function keys.

FIG. 1 is a plan view of a computer keyboard 11 having a plurality of keys including an Alpha-Numeric Core 10, Space Bar 26, Number Pad/Cursor Control Group 22 and other character, control and function keys 24.

Each of the keys on the keyboard has a finger-strike surface 32 which is the surface of the key that is touched or struck by a fingertip to operate the key.

Figure 2:
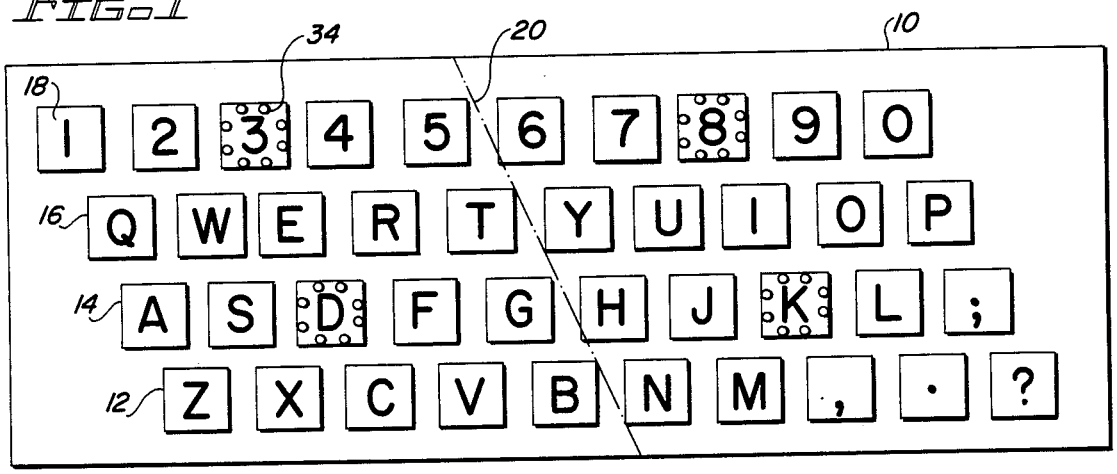
FIG. 2 is an enlarged plan view of the Alpha-Numeric Core with the hand positioning structure on the D K 3 and 8 keys.

FIG. 2 shows the preferred embodiment for the Alpha-Numeric Core 10 of the keyboard. The Alpha-Numeric Core has 40 keys arranged in four transverse rows 12, 14, 16 and 18 with ten keys in each row. Three rows 12, 14, 16 have all of the letter keys and several punctuation marks; and one row 18 has the number keys.

For reference purposes, as the Core is viewed from the operating position, the rows are designated Nearest 12, Second Nearest 14, Third Nearest 16 and Fourth Nearest 18 in sequence from nearest to farthest, and the keys in each row are designated First, Second, Third, Fourth, Fifth, Sixth, Seventh, Eighth, Ninth and Tenth in sequence from left to right.

The sequence of number and letters in the rows in this Standard or QWERTY arrangement is:

Fourth Nearest Row 18: 1 2 3 4 5 6 7 8 9 and 0
Third Nearest Row 16: Q W E R T Y U I O and P
Second Nearest Row 14: A S D F G H J K L and ;
Nearest Row 12: Z X C V B N M , . and ?

Line 20 divides the Core into left hand and right hand sectors. In operating the Core with the fingers of both hands, the keys to the left of line 20 are operated by the left hand, and the keys to the right of line 20 are operated by the right hand.

The fingers of the left hand operate the First, Second, Third, Fourth, and Fifth keys in each of the four rows, ie,

| | | | | |
|---|---|---|---|---|
| 1 | 2 | 3 | 4 | 5 |
| Q | W | E | R | T |
| A | S | D | F | G |
| Z | X | C | V | B |

The fingers of the right hand operate the Sixth, Seventh, Eighth, Ninth, and Tenth keys in each of the four rows, ie,

| | | | | |
|---|---|---|---|---|
| 6 | 7 | 8 | 9 | 0 |
| Y | U | I | O | P |
| H | J | K | L | ; |
| N | M | , | . | ? |

The keys operated by the Middle Fingers in the Second Nearest Row and the Fourth Nearest Row of the Alpha-Numeric Core, ie. D K 3 and 8 are provided with hand positioning structures to enable positioning of the Middle Fingers on these four keys without looking at the keyboard. The other keys in the Alpha-Numeric Core do not have hand positioning structures on them.

The D key is the structural center of the 15 keys in the Core operated by the Left Hand in the Nearest, Second Nearest and Third Nearest Rows, and the K key is the structural center of the 15 keys in the Core operated by the Right Hand in the Nearest, Second Nearest and Third Nearest Rows.

The 3 key is the structural center of the 5 number keys operated by the Left Hand in the Fourth Nearest Row, and the 8 key is the structural center of the 5 number keys operated by the Right Hand in the Fourth Nearest Row.

Figure 4:
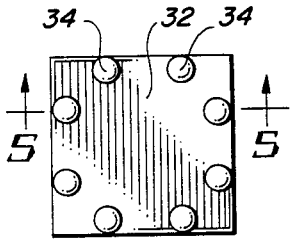
FIG. 4 is an enlarged plan view of the top of a key having the hand positioning structure.
Figure 5:
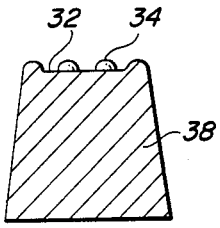
FIG. 5 is a cross-sectional view taken along the line 5—5 of FIG. 4 with the hand positioning structure molded integrally into the key.

FIG. 4 shows the top of a key having the hand positioning structure, and FIG. 5 is a cross-sectional view of said key with the hand positioning structure integrally formed.

On the perimeter of the finger-strike surface 32 are a plurality of three dimensional shapes 34 raised above the fingerstrike surface of the key.

The preferred shape of each three dimensional shape is substantially conical with rounded top.

The preferred number of raised three dimensional shapes on the perimeter of the key is 8 with two each on the right, left, nearer, and farther portions of the perimeter, thereby forming an omni-directional ridge of raised three dimensional shapes on the perimeter of the fingerstrike surface.

Adjacent three dimensional shapes being spaced apart and raised above the finger-strike surface, the raised three dimensional shapes can be sensed with light touch by the fingertip of the middle finger by the neuro-sensory process of 2-point discrimination and identified by the neuro-sensory process of stereognosis.

The rounded tops of the hand positioning structure are above the horizontal plane of the fingerstrike surface of the key immediately adjacent to the left and the key immediately adjacent to the right of each key having the hand positioning structure. However, the rounded tops of the hand positioning structure may be at the same level as the horizontal plane of the fingerstrike surface of the key immediately adjacent to the left and the key immediately adjacent to the right, or below said horizontal plane.

As shown in FIG. 5, the hand positioning structure may be an integral part of the key formed, for example, by molding when the key itself is formed.

Figure 6:
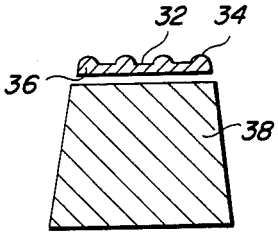
FIG. 6 is a cross-sectional view taken along the line 5—5 of FIG. 4 with the hand positioning structure attached by adhesive.

As shown in FIG. 6, the hand positioning structure 36 may be attached to an existing key 38 with adhesive, or by other attachment means. As an attachment, the hand positioning structure can be attached permanently or can be removable at will. Each of the raised three dimensional shapes can be attached individually, and can be attached permanently or can be removable at will.

When two or more of the raised geometrical shapes are touched by the middle fingertip, the skin in the fingertip is depressed and the nerve fibers in the fingertip are stimulated. The pattern and location of the stimuli produced by the shapes touched is position orienting and indicates where the Middle Finger is in relation to the key having the hand positioning structure and indicates what direction the hand must move to position the middle finger on the key having the hand positioning structure and thereby position the hand in its operating position.

With minimal practice, use of the hand positioning structure quickly functions at a subconscious reflex level.

Positioning and maintaining the position of the Middle Fingers on the Alpha-Numeric Core will be described by reference to the Right Middle Finger and the K key, i.e. the 8th key in the second Nearest Row. Positioning and maintaining position of the Left Middle Finger on the D key is the same with the directions of hand movement reversed.

When the Right Middle Fingertip is seated in its hand positioning structure on the K key, the Right Hand is properly positioned to operate the Right Hand sector of the Core, and the operator senses the raised three dimensional shapes evenly balanced around the Right Middle Fingertip.

To locate the K key the operator moves the fingers of the Right Hand over the Right Hand sector of the Alpha-Numeric Core with the fingertip of the Right Middle Finger slightly closer to the keyboard surface than the fingertips of the other fingers until the Right Middle Fingertip senses raised three dimensional shapes of the hand positioning structure on the K key. The operator then continues moving the hand in the appropriate direction until the Right Middle Fingertip senses the raised three dimensional shapes evenly balanced around the fingertip.

When the operator senses neuro-sensory stimuli from the raised three dimensional shapes only on the left side of the Right Middle Fingertip, the Right Middle Finger is to the right of the K key. To position the Right Middle Finger on the K key, the operator moves the Right Hand leftward until the operator senses the raised three dimensional shapes evenly balanced around the fingertip at which point the Right Middle Fingertip is seated in its operating position on the K key.

When the operator senses neruo-sensory stimuli from the raised three dimensional shapes only on the right side of the Right Middle Fingertip, the finger is to the left of the K key. To position the Right Middle Finger on the K key, the operator moves the Right Hand rightward until the operator senses the raised three dimensional shapes evenly balanced around the Right Middle Fingertip, at which point the Right Middle Fingertip is seated in its operating position on the K key.

Touching any two or more adjacent raised three dimenisonal shapes of the hand positioning structure on the K key with the Right Middle Fingertip indicates to the operator the position of the Right Middle Finger relative to the location of the K key.

The hand positioning structure on the K key enables the operator to position the Right Middle Finger on the K key by touch without looking at the keyboard, which thereby enables the operator to maintain focus and concentration on the text or display screen, and thereby eliminates unnecessary eye movement and text-reading errors due to eye movement, and provides a pivot point enabling the fingers of the Right Hand to comfortably reach the keys in the Right Hand sector without awkward movement or distortion.

The hand positioning structure, being on the entire perimeter of the finger-strike surface of the K key, rather than in the middle or on only one side of the fingerstrike surface, provides the earliest positional sensory guidance in all directions; and is omni-directional and thereby provides positional sensory guidance for the fingertip of the Right Middle Finger in all directions.

Hand positioning by positioning the Middle Fingers correlates with the anatomical structure and biomechanical functioning of the arms, wrists, hands and fingers in operating the keyboard.

The Middle Finger, being the long finger of each hand, has the earliest, fastest and most continuous contact with its Second Nearest Row key compared to the other fingers. Therefore, hand positioning and maintaining hand position with the Middle Finger is faster and more continuous, and also provides greater hand and finger flexibility, mobility, fluidity of movement and reach.

The bones of each Middle Finger, metacarpal of the middle finger, capitate and radius of the forearm form an "anatomical central ray" structure. The other bones of the hand and fingers are suspended from each central ray structure. The Middle Finger is in direct anatomical alignment with the anatomical center of the hand and the center of axial rotation. Therefore, positioning and maintaining position with the Middle Finger provides within hand balance, dynamic symmetry and reduces rotational torque and reduces the muscle tension required to counter the rotational torque resulting from hand placement by eccentric means. In addition, since peripheral fingers move through smaller horizontal and rotational arcs, the potential for errors due to the peripheral fingers striking the wrong keys is reduced.

An unexpected new result of this invention is that with the fingertips of the Middle Fingers seated within the hand positioning structures on the D and K keys, the other keys in the Alpha-Numeric Core are now easily and accurately operable, which thereby eliminates Home Row. It is not necessary for the operator to place all 8 fingers of the Right Hand on or over the Home Row keys A S D F J K L ; nor to operate the Core from Home Row which is inefficient, time consuming and causes errors. It is necessary only that the operator position and maintain position of the Middle Fingers within the hand positioning structures on the Third and Eighth keys in the Second Nearest Row.

With Home Row, fingers are anchored on or over the Home Row keys, which results in awkward extension and flexion movements from the Home Row keys and which actually imposes finger contortions on the operator.

Eliminating placing and maintaining the fingers on Home Row thereby eliminates these awkward extension and flexion movements and contortions and eliminates the errors resulting from those awkward movements and contortions, and also eliminates the time and energy required to move from a Home Row key to the key to be operated and back to Home Row. By eliminating the placing and maintaining the fingers on Home Row, the hand positioning structure thereby provides greater accessibility, mobility, flexibility, fluidity of movement, speed, accuracy, efficiency, and facilitates learning how to operate the keyboard.

Providing hand positioning structures on the Third and Eighth keys in the Fourth Nearest Row, i.e. the 3 and 8 keys in the Number Row, enables the operator to operate the Number Row keys with the hands positioned on the Number Row, rather than operating the Number Row keys with the hands positioned on the A S D F J K L ; keys in the Second Nearest Row. The 3 key is the center key of the Number Row keys operated by the left hand, i.e. 1 2 3 4 5, and is operated by the left Middle Finger, and the 8 key is the center key of the Number Row keys operated by the Right Hand, i.e. 6 7 8 9 0, and is operated by the right Middle Finger.

Operating the Number Row keys with the hands positioned on the Number Row, rather than with the hands positioned on the A S D F J K L ; keys in the Second Nearest Row eliminates extension and stretching of the fingers from the Second Nearest Row to the Fourth Nearest Row, eliminates awkward finger movements and contortions, and improves speed, accuracy and efficiency in doing numbers.

Figure 3:
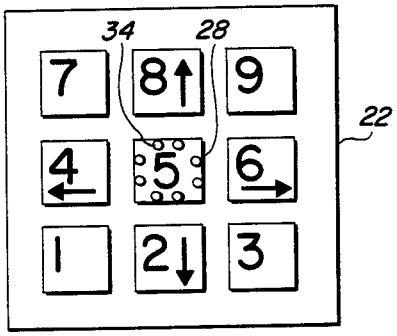
FIG. 3 is an enlarged plan view of the Number Pad/-Cursor Control Group with the hand positioning structure on the 5 key.

FIG. 3 shows a Number Pad/Cursor Control Group having a plurality of keys with nine keys arranged in a substantially rectangular matrix of 3 rows of keys with 3 keys in each row, and are assigned the numbers 1 2 3 4 5 6 7 8 9. Four keys are also assigned cursor control functions designated by an arrow.

When the Number Pad/Cursor Control Group is operated by the Right Hand, the left column of 3 keys, i.e. Numbers 7 4 and 1, are operated by the Right Index Finger, the middle column of 3 keys, i.e. Numbers 8 5 and 2, are operated by the Right Middle Finger, and the right column of 3 keys, i.e. Numbers 9 6 and 3 are operated by the Right Ring Finger.

The center key 28 in the matrix of 9 keys, which is assigned the number 5, is provided with the hand positioning structure to enable positioning the Middle Finger on this center key without looking at the Number Pad/Cursor Control Group. The other keys in the Number Pad/Cursor Control Group do not have hand positioning structures. With the Middle Finger positioned on the center key, the Number Pad/Cursor Control Group can be operated by the fingers of one hand without looking at the Number Pad/Cursor Control Group.

The benefits of the hand positioning structure on the specified Middle Finger keys are substantial. The benefits include providing bio-mechanical balance and symmetry for the fingers and hands, and improving keyboard operation by increasing operating speed, accuracy and productivity; reducing operator mental, emotional, visual, and neuro-muscular stress and fatigue; and facilitating learning how to operate a keyboard. The cost of the structure is nominal; no employee retraining expense is required.

Although the invention has been described and illustrated with reference to specific embodiments thereof, it is not intended that the reader construe these as limitations on the scope of the invention or that the invention be limited to these illustrative embodiments. Those skilled in the art will appreciate, after study of the foregoing description, that variations and modifications differing from the illustrative embodiments may be made without departing from the spirit of the invention. For example, skilled artisans could change the dimensions and shapes of the embodiment, or could put the hand positioning structure on additional keys such as function or control keys, or on keys operated by other fingers. Accordingly, the scope of the invention is determined by the appended claims and their legal equivalents, and not by examples which have been given. It is intended that all variations and modifications that fall within the appended claims be included within the invention.

What is claimed is:

1. In a keyboard for computers, including terminals and input devices, word processing equipment, typewriters, and similar equipment, and simulators of such equipment, an improvement comprising:

a core structure comprising a plurality of keys, each of said keys having a fingerstrike surface which is the surface of the key that is touched or tapped by a fingertip to operate the key;

said plurality of keys having a left hand plurality of keys operable by touch with the fingertips of the index, middle, ring and little fingers of the left hand, and a right hand plurality of keys operable by touch with the fingertips of the index, middle, ring and little fingers of the right hand;

said left hand plurality of keys having a left hand positioning key being a key operated by the left middle finger, and said right hand plurality of keys having a right hand positioning key being a key operated by the right middle finger;

said core structure having means for positioning and maintaining the position of the fingertip of each middle finger on its hand positioning key by touch, and thereby positioning and maintaining the positions of the hands on said core structure by touch;

said means comprising:

at least three spaced apart three dimensional shapes on or near the perimeter of the fingerstrike surface on each of said left and right hand positioning keys;

the keys in said core structure other than said left and right hand positioning keys and other than additional hand positioning keys being free of said spaced apart three dimensional shapes;

said plurality of spaced apart three dimensional shapes on each of said left and right hand positioning keys being raised above the fingerstrike surface of each of said hand positioning keys;

the topmost parts of adjacent raised spaced apart three dimensional shapes being of sufficient height above each fingerstrike surface and there being sufficient space between the topmost parts of adjacent three dimensional shapes to enable neuro-sensory two-point discrimination and stereognosis by the fingertip of each middle finger;

the number and locations of said three dimensional shapes on the fingerstrike surface of each hand positioning key providing omni-directional positional and directional orientation of the position of the middle fingertip in relation to its hand positioning key and the direction to move the hand to position said middle fingertip on its hand positioning key;

whereby the fingertip of each middle finger is positioned on its hand positioning key by touch, and whereby the hands maintain accurate position for operating the core structure by touch with the fingers of both hands.

2. The keyboard core structure of claim 1 with the keys in the core structure being in transverse rows and with the keys in the transverse rows third nearest, second nearest and nearest the operator being assigned the following characters in sequence from left to right:

third nearest row: q w e r t y u i o and p
second nearest row: a s d f g h j k l and ;
nearest row: z x c v b n m , . and ?

which key arrangement is known as the standard or qwerty arrangement, and with the raised three dimensional shapes being on the d and k keys.

3. The keyboard core structure of claim 1 with the keys in the core structure being in transverse rows and with the keys in the transverse rows third nearest, second nearest and nearest the operator being assigned the following characters in sequence from left to right:

third nearest row: ', . p y f g c r and l
second nearest row: a o e u i d h t n and s
nearest row: ; q j k x b m w v and z which key arrangement is known as the alternate standard or dvorak arrangement, and with the raised three dimensional shapes being on the e and t keys.

4. The keyboard core structure of claim 1 with the keys in the core structure being in transverse rows and with the keys in the transverse row of keys fourth nearest the operator being assigned the digits 1 2 3 4 5 6 7 8 9 and 0 in sequence from left to right, and with the raised three dimensional shapes being on the 3 and 8 keys in said fourth nearest row.

5. The keyboard core structure of claim 1 in which the three dimensional shapes are substantially conical in shape with rounded top.

6. The keyboard core structure of claim 1 in which there is a plurality of three dimensional shapes on each of the left, right, nearest and farthest parts of the perimeter of the fingerstrike surface of each key having said three dimensional shapes.

7. The keyboard core structure of claim 1 with additional keys to the left, right, nearer, and/or beyond said keyboard core structure, and at least one additional key located outside said keyboard core structure having a plurality of raised three dimensional shapes on the perimeter of the fingerstrike surface of said additional key.

8. The keyboard core structure of claim 1 in which the topmost parts of the three dimensional shapes are higher in elevation than the horizontal plane of the fingerstrike surfaces of each key immediately adjacent to and in the same row as each hand positioning key.

9. The keyboard core structure of claim 1 in which the topmost parts of the three dimensional shapes are substantially the same elevation as the horizontal plane of the fingerstrike surfaces of each key immediately adjacent to and in the same row as each hand positioning key.

10. The keyboard core structure of claim 1 in which the topmost parts of the three dimensional shapes are lower in elevation than the horizontal plane of the fingerstrike surfaces of each key immediately adjacent to and in the same row as each hand positioning key.

11. The keyboard core structure of claim 1 in which the three dimensional shapes are formed integrally with the fingerstrike surfaces of the hand positioning keys.

12. The keyboard core structure of claim 1 in which the three dimensional shapes are attached to the fingerstrike surfaces of the hand positioning keys by attachment means such as adhesive or clips.

13. A method of operating a keyboard for computers, including terminals and input devices, word processing equipment, typewiriters, and similar equipment, and simulators of such equipment, with the fingers of both hands by touch without looking at the keyboard, said method comprising the steps of:

providing a keyboard with a core structure comprising a plurality of keys, each of said keys having a fingerstrike surface which is the surface of the key that is touched or tapped by a fingertip to operate the key;

said plurality of keys having a left hand plurality of keys operable by touch with the fingertips of the index, middle, ring and little fingers of the left hand, and a right hand plurality of keys operable by touch with the fingertips of the index, middle, ring and little fingers of the right hand;

designating the finger of each hand to operate each key in the Core Structure;

providing the left hand plurality of keys with a left hand positioning key being a key operated by the left middle finger, and providing the right hand plurality of keys with a right hand positioning key being a key operated by the right middle finger;

providing said core structure with means for positioning and maintaining the position of the fingertip of each middle finger on its hand positioning key by touch, and thereby positioning and maintaining the positions of the hands on said core structure by touch;

said means comprising:

at least three spaced apart three dimensional shapes on or near the perimeter of the fingerstrike surface on each of said left and right hand positioning keys;

the keys in said core structure other than said left and right hand positioning keys and other than additional hand positioning keys being free of said spaced apart three dimensional shapes;

said plurality of spaced apart three dimensional shapes on each of said left and right hand positioning keys being raised above the fingerstrike surface of each of said hand positioning keys;

the topmost parts of adjacent raised spaced apart three dimensional shapes being of sufficient height above each fingerstrike surface and there being sufficient space between the topmost parts of adjacent three dimensional shapes to enable neuro-sensory two-point discrimiination and stereognosis by the fingertip of each middle finger;

the number and locations of said three dimensional shapes on the fingerstrike surface of each hand positioning key providing omni-directional positional and directional orientation of the position of the middle fingertip in relation to its hand positioning key and the direction to move the hand to position said middle fingertip on its hand positioning key;

whereby the fingertip of each middle finger is positioned on its hand positioning key by touch, and whereby the hands maintain accurate position for operating the core structure by touch with the fingers of both hands;

positioning the keyboard in front of the operator;

positioning the right hand on the keyboard by moving it in an appropriate direction to position the right middle fingertip on the right hand positioning key;

said moving step including:

moving the fingers of the right hand over the right hand plurality of keys with the fingertip of the right middle finger slightly closer to the keyboard surface than the fingertips of the other fingers of the right hand to enable the right middle fingertip to sense the raised three dimensional shapes on the fingerstrike surface of the right hand positioning key;

upon the right middle fingertip sensing neuro-sensory stimuli from any of said raised three dimensional shapes on said right hand positioning key, determiming the position of the right middle finger in relation to said right hand positioning key from said stimuli and determining the direction the right hand should be moved to position the right middle fingertip on the right hand positioning key from said stimuli;

moving the right hand to the left, right, nearer, farther or obliquely until the neuro-sensory stimuli from the raised three dimensional shapes on said right hand positioning key are substantially evenly balanced around the right middle fingertip, which indicates the right middle fingertip is positioned on the right hand positioning key and the right hand is properly positioned to accurately operate the right hand plurality of keys by touch;

and positioning the left hand by positioning the left middle fingertip on the left hand positioning key by equivalent steps and movements to accurately operate the keys in the left hand part of the core structure by touch;

operating the keys of the core structure with the finger designated for each key;

the positioning of the middle finger of each hand on its respective hand positioning key enabling the other fingers to move as necessary to operate their keys in the core structure while maintaining the accurate position of each hand on the core structure without looking at the keyboard, whereby the fingers of each hand are enabled to accurately and comfortably operate their keys, and whereby errors resulting from inaccurate hand position are eliminated;

during operation of the core structure, sensing the absence of neuro-sensory stimuli to a middle fingertip when it is not operating a key indicating the hand is not in proper operating position, and repositioning the hand as described herein;

and sensing neuro-sensory stimuli other than substantially evenly balanced around the middle fingertip indicating the middle fingertip is not in its proper operating position and indicating the direction the hand should be moved to reposition the middle fingertip on its positioning key, and repositioning the hand as described herein;

whereby the operator is enabled to maintain visual focus and concentration on the text or visual display screen and whereby unnecessary eye movement and text reading errors due to eye movement are eliminated;

whereby the operator is enabled to operate the core structure with greater operating speed, accuracy, productivity, mobility, flexibility, accessibility and efficiency, and operator mental, emotional, visual and neuro-muscular stress and fatigue are eliminated, and learning how to operate the keyboard is facilitated.

14. The method of claim 13 whereby placing and maintaining the fingers on the traditional home row of eight keys in the second nearest row is eliminated, and whereby the movements involved in maintaining home row positions are eliminated.

15. A method of operating the number row of a keyboard for computers, including terminals and input devices, word processing equipment, typewriters, and similar equipment, and simulators of such equipment, with the fingers of both hands by touch without looking at the keyboard, said method comprising the steps of:

providing a keyboard with a number row having a plurality of keys in a substantially transverse row with a number assigned to each of said keys in said number row, each of said keys in said number row having a fingerstrike surface which is the surface of the key that is touched or tapped by a fingertip to operate the key;

said number row having a left hand plurality of keys operable by touch with the fingertips of the index, middle, ring and little fingers of the left hand, and a right hand plurality of keys operable by touch with the fingertips of the index, middle, ring and little fingers of the right hand;

designating the finger of each hand to operate each key in said number row;

providing said left hand plurality of keys in said number row with a left hand number row positioning key being a key operated by the left middle finger, and providing the right hand plurality of keys in said number row with a right hand number row positioning key being a key operated by the right middle finger;

providing means for positioning and maintaining the position of the fingertip of each middle finger on its number row hand positioning key by touch, and thereby positioning and maintaining the positions of the hands on said number row by touch;

said means comprising:

at least three spaced apart three dimensional shapes on or near the perimeter of the fingerstrike surface on each of said left and right hand number row positioning keys;

the keys in said number row other than said left and right hand number row positioning keys and other than additional hand positioning keys being free of said spaced apart three dimensional shapes;

said plurality of spaced apart three dimensional shapes on each of said left and right number row hand positioning keys being raised above the fingerstrike surface of each of said number row hand positioning keys;

the topmost parts of adjacent raised spaced apart three dimensional shapes being of sufficient height above each fingerstrike surface and there being sufficient space between the topmost parts of adjacent three dimensional shapes to enable neuro-sensory two-point discrimination and stereognosis by the fingertip of each middle finger;

the number and locations of said three dimensional shapes on the fingerstrike surface of each number row hand positioning key providing omni-directional position and directional orientation of the position of the middle fingertip in relation to its number row hand positioning key and the direction to move the hand to position said middle fingertip on its number row hand positioning key;

whereby the fingertip of each middle finger is positioned on its number row hand positioning key by touch, and whereby the hands maintain accurate position for operating the number row by touch with the fingers of both hands;

positioning the keyboard in front of the operator;

positioning the right hand on the number row of the keyboard by moving it in the appropriate direction to position the right middle fingertip on the right number row hand positioning key;

said moving step including:

moving the fingers of the right hand over the right hand plurality of keys with the fingertip of the right middle finger slightly closer to the keyboard surface than the fingertips of the other fingers of the right hand to enable the right middle fingertip to sense the raised three dimensional shapes on the fingerstrike surface of the right number row hand positioning key;

upon the right middle fingertip sensing neuro-sensory stimuli from any of said raised three dimensionl shapes on said right number row hand positioning key, determining the position of the right middle finger in relation to said right number row hand positioning key from said stimuli and determining the direction the right hand should be moved to position the right middle fingertip on the right number row hand positioning key from said stimuli;

moving the right hand to the left, right, nearer, farther or obliquely until the neuro-sensory stimuli from the raised three dimensional shapes on said right number row hand positioning key are substantially evenly balanced around the right middle fingertip, which indicates the right middle fingertip is positioned on the right number row hand positioning key and the right hand is properly positioned to accurately operate the right hand plurality of keys in the number row by touch;

and positioning the left hand by positioning the left middle fingertip on the left number row hand positioning key by equivalent steps and movements to accurately operate the keys in the left hand part of the number row by touch;

operating the keys of the number row with the finger designated for each key;

the positioning of the middle finger of each hand on its respective number row hand positioning key enabling the other fingers to move as necessary to operate their keys in the number row while maintaining the accurate position of each hand on the number row without looking at the keyboard, whereby the fingers of each hand are enabled to accurately and comfortably operate their number row keys, and whereby errors resulting from inaccurate hand positioning are eliminated;

during operation of the number row, sensing the absence of neuro-sensory stimuli to a middle fingertip when it is not operating a key indicating the hand is not in proper operating position, and repositioning the hand as described herein;

and sensing neuro-sensory stimuli other than substantially evenly balanced around the middle fingertip indicating the middle fingertip is not in its proper operating position and indicating the direction the hand should be moved to reposition the middle fingetip on its number row hand positioning key, and repositioning the hand as described herein;

whereby the operator is enabled to maintain visual focus and concentration on the text or visual display screen whereby unnecessary eye movement and text reading errors due to eye movement are eliminated;

whereby the operator is enabled to operate the number row with greater operating speed, accuracy, productivity, mobility, flexibility, accessibility and efficiency, and operator mental, emotional, visual and neuro-muscular stress and fatigue are eliminated, and learning how to operate the number row is facilitated.

16. The method of claim 15 whereby operating the number row by placing and maintaining the fingers on the traditional home row of eight keys in the second nearest row is eliminated, and whereby the movements involved in maintaining home row positions when doing numbers are eliminated.

17. The method of claim 15 with the keys in the number row designated 1, 2, 3, 4, 5, 6, 7, 8, 9, 0 in sequence from left to right and with the 3 being the left number row hand positioning key and 8 being the right number row hand positioning key.

* * * * *